US006431695B1

(12) United States Patent
Johnston et al.

(10) Patent No.: US 6,431,695 B1
(45) Date of Patent: Aug. 13, 2002

(54) MICROSTRUCTURE LIQUID DISPENSER

(75) Inventors: Raymond P. Johnston, Lake Elmo; Thomas I. Insley, West Lakeland Township, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/099,555

(22) Filed: Jun. 18, 1998

(51) Int. Cl.[7] ..... B41J 2/175
(52) U.S. Cl. ..... 347/86
(58) Field of Search ..... 347/84, 85, 86, 347/87; 401/222, 223

(56) References Cited

U.S. PATENT DOCUMENTS

| | | | | |
|---|---|---|---|---|
| 2,522,554 A | | 9/1950 | Zodtner | |
| 2,648,309 A | | 8/1953 | Bartell | |
| 2,670,711 A | | 3/1954 | Wittnebert | |
| 2,855,898 A | | 10/1958 | Dyson | |
| 3,283,787 A | * | 11/1966 | Davis | 138/148 |
| 3,715,192 A | | 2/1973 | Wenz et al. | 23/253 TP |
| 3,993,566 A | | 11/1976 | Goldberg et al. | |
| 4,233,029 A | | 11/1980 | Columbus | 23/230 R |
| 4,271,119 A | | 6/1981 | Columbus | 422/50 |
| 4,277,966 A | | 7/1981 | Rambauske | 72/148 |
| 4,323,069 A | | 4/1982 | Ahr et al. | 128/287 |

(List continued on next page.)

FOREIGN PATENT DOCUMENTS

| | | |
|---|---|---|
| DE | 32 12 295 | 10/1983 |
| DE | 42 10 072 | 3/1993 |
| DE | 195 01 017 | 7/1996 |
| EP | 0 039 291 | 11/1981 |
| EP | 0 329 340 | 8/1989 |
| EP | 0 640 385 A1 | 8/1993 |
| GB | 848851 | 9/1960 |
| GB | 1 338 579 | 11/1973 |
| GB | 1 354 502 | 5/1974 |
| GB | 1 418 635 | 12/1975 |

(List continued on next page.)

OTHER PUBLICATIONS

Guerin et al. Article: "Simple and Low Cost Fabrication of Embedded Micro–Channels by Using a New Thick–Film Photoplastic", 1997 Int'l Conf. In Solid–State Sensors and Actuators, *Digest of Technical Papers,* vol. 2, Jun. 1997.

Becker, et al. Article: "Fabrication of Microstructures with high aspect ratios and great structural heights by synchrotron radiation lithography, galvanoforming, and plastic moulding (LIGA process)", *Microelectronic Engineering 4* (1986).

Roberts, et al. Article "UV Laser Machined Polymer Substrates for the Development of Microdiagnostic Systems", *Analytical Chemistry,* vol. 69, No. 11, Jun. 1997.

Ottow, S. et al., Processing of Three–Dimensional Microstructures Using Macroporous n–Type Silicon, J. Electrochem. Soc. vol. 143, No. 1, pp. 385–390 (Jan. 1996).

Zuska, P., Microtechnology Opens Doors to the Universe of Small Space, Medical Device & Diagnostic Industry, pp. 131–137 (Jan. 1997).

Bassous, E., Fabrication of Novel Three–Dimensional Microstructures by the Anisotropic Etching of (100) and (110) Silicon, IEEE Transactions On Electron Devices, vol. ED–25, No. 10, Oct. 1978.

*Primary Examiner*—Judy Nguyen
(74) *Attorney, Agent, or Firm*—Christopher D. Gram; Stephen W. Buckingham; Robert W. Sprague

(57) ABSTRACT

Liquid dispensers comprising a reservoir including a plurality of elongated channels formed from overlaying layers of microstructured film having a dispensing edge, each elongated channel having an outlet at the dispensing edge, wherein liquid can be stored in the reservoir, and a transfer element in fluid communication with the dispensing edge of the reservoir that provides a location from which liquid stored in the reservoir can be controllably dispensed.

31 Claims, 10 Drawing Sheets

U.S. PATENT DOCUMENTS

| | | | | | |
|---|---|---|---|---|---|
| 4,392,362 | A | | 7/1983 | Little | |
| 4,413,407 | A | | 11/1983 | Columbus | |
| 4,525,166 | A | | 6/1985 | Leclerc | 604/133 |
| 4,533,352 | A | | 8/1985 | Van Beek et al. | 604/317 |
| 4,579,555 | A | | 4/1986 | Russo | |
| 4,601,861 | A | | 7/1986 | Pricone et al. | |
| 4,623,329 | A | | 11/1986 | Drobish et al. | 604/29 |
| 4,639,748 | A | | 1/1987 | Drake et al. | |
| 4,668,558 | A | | 5/1987 | Barber | 428/156 |
| 4,677,705 | A | | 7/1987 | Schuster | |
| 4,679,590 | A | | 7/1987 | Hergenroeder | 137/602 |
| 4,758,481 | A | | 7/1988 | Fauvel | |
| 4,809,396 | A | | 3/1989 | Houser | |
| 4,871,623 | A | | 10/1989 | Hoopman et al. | 428/586 |
| 4,906,439 | A | | 3/1990 | Grenner | |
| 4,913,858 | A | | 4/1990 | Miekka et al. | |
| 4,921,492 | A | | 5/1990 | Schultz et al. | |
| 4,950,549 | A | | 8/1990 | Rolando et al. | |
| 5,014,389 | A | | 5/1991 | Ogilvie et al. | |
| 5,042,978 | A | | 8/1991 | Quenin et al. | 604/317 |
| 5,047,790 | A | * | 9/1991 | Cowger et al. | 347/87 |
| 5,069,403 | A | | 12/1991 | Marentic et al. | 244/130 |
| 5,070,606 | A | | 12/1991 | Hoopman et al. | 29/890.03 |
| 5,078,925 | A | | 1/1992 | Rolando et al. | |
| 5,133,516 | A | | 7/1992 | Marentic et al. | 244/130 |
| 5,152,060 | A | | 10/1992 | Schubert et al. | |
| 5,158,557 | A | | 10/1992 | Noreen et al. | |
| 5,175,030 | A | | 12/1992 | Lu et al. | 428/30 |
| 5,176,667 | A | | 1/1993 | DeBring | |
| 5,200,248 | A | | 4/1993 | Thompson et al. | 428/131 |
| 5,249,359 | A | | 10/1993 | Schubert et al. | 29/890.039 |
| 5,314,743 | A | | 5/1994 | Meirowitz et al. | 428/297 |
| 5,317,805 | A | | 6/1994 | Hoopman et al. | |
| 5,368,910 | A | | 11/1994 | Langdon | |
| 5,376,252 | A | | 12/1994 | Ekström et al. | |
| 5,411,858 | A | | 5/1995 | McGeehan et al. | |
| 5,437,651 | A | | 8/1995 | Todd et al. | |
| 5,440,332 | A | | 8/1995 | Good | 347/42 |
| 5,450,235 | A | | 9/1995 | Smith et al. | |
| 5,500,071 | A | | 3/1996 | Kaltenbach et al. | 156/272.8 |
| 5,514,120 | A | | 5/1996 | Johnston et al. | 604/378 |
| 5,527,588 | A | | 6/1996 | Camarda et al. | 428/188 |
| 5,534,576 | A | | 7/1996 | Grot | |
| 5,536,699 | A | | 7/1996 | Ghelfi et al. | |
| 5,571,410 | A | | 11/1996 | Swedberg et al. | 210/198 |
| 5,601,678 | A | | 2/1997 | Gerber et al. | |
| 5,628,735 | A | | 5/1997 | Skow | |
| 5,641,400 | A | | 6/1997 | Kaltenbach et al. | 210/198 |
| 5,651,888 | A | | 7/1997 | Shimizu et al. | |
| 5,658,413 | A | | 8/1997 | Kaltenbach et al. | |
| 5,691,846 | A | | 11/1997 | Benson, Jr. et al. | |
| 5,692,263 | A | | 12/1997 | Sorenson | |
| 5,703,633 | A | | 12/1997 | Gehrer et al. | |
| 5,728,446 | A | | 3/1998 | Johnston et al. | 428/167 |
| 5,885,470 | A | | 3/1999 | Parce et al. | |
| 5,932,315 | A | | 8/1999 | Lum et al. | |

FOREIGN PATENT DOCUMENTS

| | | | | |
|---|---|---|---|---|
| JP | 57 73623 A | * | 5/1982 | G01D/15/16 |
| JP | S57-73623 | | 5/1982 | |
| JP | H01-25292 | | 7/1989 | |
| WO | WO 89/04628 | | 6/1989 | |
| WO | WO 93/11727 | | 6/1993 | |
| WO | WO 96/10747 | | 4/1996 | |
| WO | WO 97/02357 | | 1/1997 | |
| WO | WO 97/13633 | | 4/1997 | |
| WO | WO 98/00231 | | 1/1998 | |
| WO | WO 98/24544 | | 6/1998 | |
| WO | WO 98/46438 | | 10/1998 | |
| WO | WO 99/06589 | | 2/1999 | |

* cited by examiner

MICROSTRUCTURE LIQUID DISPENSER

TECHNICAL FIELD

The present invention relates generally to microstructure-bearing film surfaces. In particular, the present invention relates to apparatus having and methods of using layers of microstructured film surfaces as a reservoir for storing and dispensing liquid.

BACKGROUND OF THE INVENTION

Microstructured film surfaces are used in a variety of products and processes. For example, U.S. Pat. Nos. 5,069,403 and 5,133,516 relate to microstructure-bearing film surfaces used to reduce drag resistance of a fluid flowing over a surface. In particular, conformable sheet material that employs a patterned first surface comprising a series of parallel peaks separated from one another by a series of parallel valleys is disclosed.

Also, microstructure-bearing film surfaces have been used to transport fluids. For example, U.S. Pat. Nos. 5,514,120 and 5,728,446 relate to absorbent articles, such as diapers, having a liquid management film that rapidly and uniformly transport liquid from a liquid permeable topsheet to an absorbent core. The liquid management film is a sheet, typically flexible, having at least one microstructure-bearing hydrophilic surface with a plurality of grooves or channels formed thereon.

Nevertheless, other new and useful applications of microstructured film surfaces are desired.

SUMMARY OF THE INVENTION

The present invention is based on the recognition that microstructured films having channels or grooves formed on a major surface of the film, when stacked, capped, and/or otherwise layered, can form an array of capillaries for containment and delivery of liquid. Liquid can be stored and subsequently dispensed, extracted, or otherwise removed from the reservoir in a number of ways. For example, the openings of the channels can be inserted into a liquid that is capable of wetting the film material so that capillary action will cause the liquid to move into the array of channels. When the openings of the channels are removed from the liquid, attractive forces between the liquid and the interior surfaces of the channels cause the liquid to remain in the channels so that the liquid is effectively contained within the array of channels. When a potential sufficient to overcome the attractive forces is applied to the openings of the channels, the liquid moves towards the openings and out of the channels so that the once-contained liquid is dispensed from the channels. The layers in which the channels are formed can be fabricated and stacked, capped, and/or otherwise layered in a linear, uniform manner to facilitate anisotropic (that is, directionally dependent) dispensing, extraction, or removal of liquid on demand in a controllable fashion.

Reservoirs of the present invention are efficient in that a high percentage of the liquid stored in the reservoir can ultimately be dispensed, extracted, or otherwise removed and are easily and economically manufactured from a variety of materials, including relatively inexpensive, flexible or rigid polymers. The structured surface features of the reservoir are highly controllable, predictable and ordered, and are formable with high reliability and repeatability using known microreplication or other techniques. The reservoirs can be produced in highly variable configurations to meet the storage and dispensing, extraction, or other removal requirements of a given application. This variability is manifested in such features as structured surface feature possibilities (for example, discrete or open channels), channel configurations (for example, wide, narrow, 'V' shaped, rectangular, primary and/or secondary channels), stack configurations (for example, bonded or unbonded, facing layers, non-facing layers, added layers, aligned channels, offset channels, and/or channel patterns), and channel outlets (for example, size, configuration, or pattern). In addition, the layers may be treated to increase or decrease the wettability of the structured surface or for other purposes.

A reservoir according to the present invention includes at least one layer of microstructured film having a plurality of elongated channels formed on a structured surface of the microstructured film. The reservoir also includes a cap layer adjacent to the structured surface of the microstructured film.

A liquid dispenser according to the present invention includes a reservoir in which liquid can be stored within a plurality of elongated channels formed from overlaying layers of microstructured film. At least one layer of microstructured film has a dispensing edge, and at least one elongated channel has an outlet at the dispensing edge. The liquid dispenser also includes a transfer element in fluid communication with the dispensing edge of the reservoir that provides a location from which liquid stored in the reservoir can be controllably dispensed.

In one embodiment, a liquid dispenser of the present invention can be in the form of an ink jet cartridge comprising a housing having an opening and a reservoir located within the housing. The reservoir includes a plurality of elongated channels formed from overlaying layers of microstructured film. At least one layer has a dispensing edge, and at least one elongated channel has an outlet at the dispensing edge. Liquid (for example, ink) can be stored in the channels of the reservoir. The ink jet cartridge also includes a transfer element that is in fluid communication with the dispensing edge of the reservoir. The transfer element is located within the housing so that the transfer element is accessible through the opening so as to provide a location from which liquid stored in the reservoir can be controllably dispensed.

In another embodiment, a liquid dispenser of the present invention can be in the form of a writing instrument. The writing instrument comprises an elongated tubular housing having an opening at one end in which a reservoir is located. The reservoir includes a plurality of elongated channels formed from overlaying layers of microstructured film in which liquid (for example, ink) can be stored. At least one layer of microstructured film has a dispensing edge, and at least one elongated channel has an outlet at the dispensing edge. The reservoir is arranged within the elongated tubular housing so that the dispensing edge is accessible through the opening. Also, the writing instrument includes a nib that has a portion inserted into the end of the elongated tubular housing through the opening so that the nib is in fluid communication with the dispensing edge and so that liquid can be controllably dispensed from the reservoir through the nib.

Furthermore, the present invention relates to a liquid dispensing method. The liquid dispensing method includes providing a reservoir having a plurality of elongated channels formed from overlaying layers of microstructured film, storing liquid in the channels of the reservoir, and controllably dispensing the liquid stored in the channels of the reservoir.

Another method according to the present invention includes providing a reservoir that includes at least one layer of microstructured film having a plurality of elongated channels formed on a structured surface of the microstructured film, storing liquid in the channels of the reservoir, and removing liquid stored in the channels of the reservoir on demand.

These figures, which are idealized, are not to scale and are intended to be merely illustrative and non-limiting.

DETAILED DESCRIPTION OF THE PREFERRED EMBODIMENTS

Figure 1:
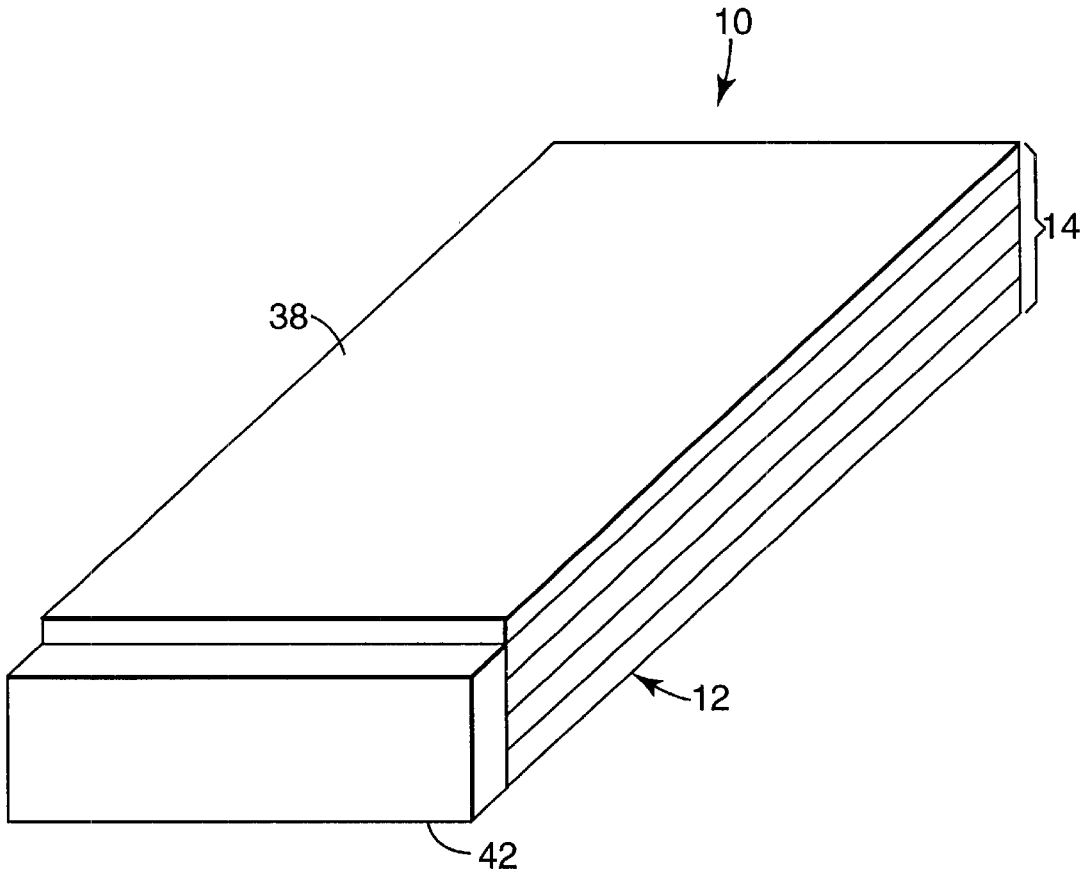
FIG. 1 is a cross-sectional, isometric schematic view of a liquid dispenser according to the present invention.
Figure 2:
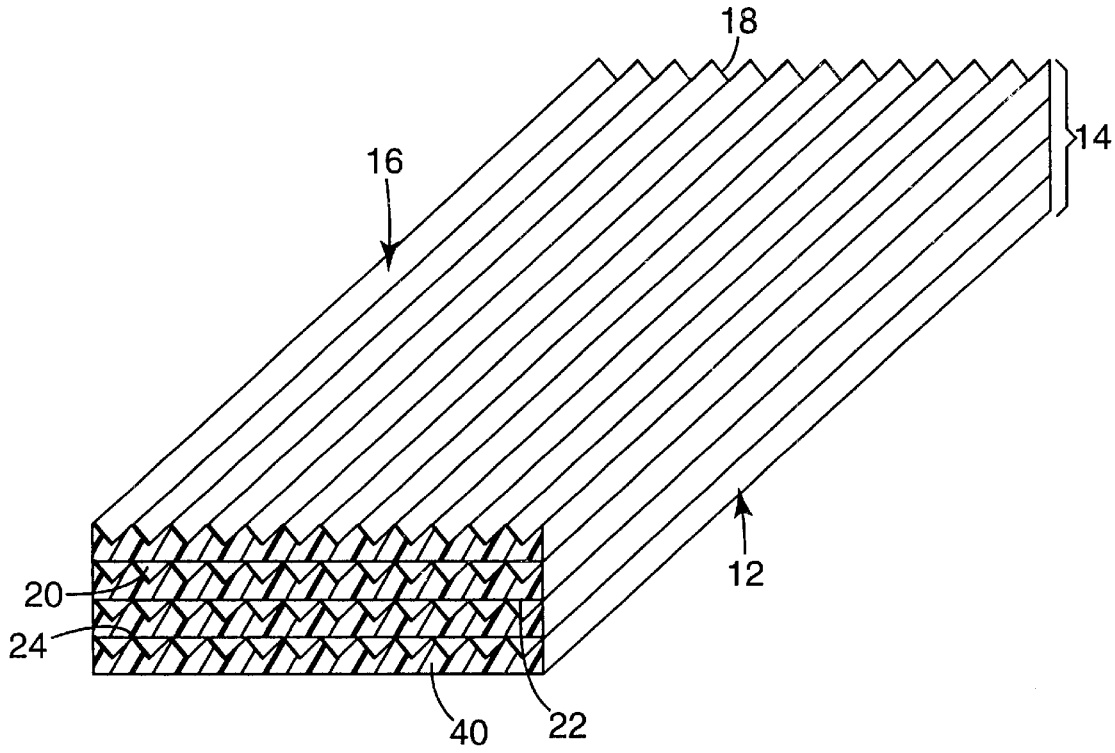
FIG. 2 is a cross-sectional, isometric schematic view of the reservoir of the liquid dispenser shown in FIG. 1.

A liquid dispenser 10 according to the present invention is shown in FIG. 1 in simplified, schematic form. Dispenser 10 includes a reservoir 12 (perhaps shown best in FIG. 2) formed from overlaying layers 14 of material, each layer 14 having a structured surface 16 on at least one of its two major surfaces. Layers 14 having structured surfaces 16 are known generally as microstructured films. As shown in FIG. 2, the structured surfaces 16 have a plurality of channels (or grooves) 18 formed within the layers 14 that are uniform and regular along substantially each channel length and from channel to channel. The channels 18 extend entirely from one edge to another edge of the structured surfaces 16; although it is to be understood that the channels 18 can extend along only a portion of one or more of the structured surfaces 16. Each channel 18 can have one or more outlets 20. The outlets 20 can be formed along an edge of each layer 14, and each layer 14 can have a dispensing edge 22 through which liquid can be made to pass. It is to be understood, however, that one or more channels 18 can be formed without outlets 20.

The layers 14 may be comprised of flexible, semi-rigid, or rigid material, which may be chosen depending on the particular application of the liquid dispenser 10. The layers 14 comprise a polymeric material because such materials can be accurately formed to create a microstructured surface 16. Substantial versatility is available because polymeric materials possess many different properties suitable for various needs. Polymeric materials may be chosen, for example, based on flexibility, rigidity, permeability, etc. The use of a polymeric layer 14 also allows a structured surface 16 to be consistently manufactured to produce a large number of and high density of channels 18. Thus, a highly ordered liquid dispenser 10 can be provided that is amenable to being manufactured with a high level of accuracy and economy.

When the layers 14 are stacked to form reservoir 12, the channels 18 can act as capillaries for acquiring, storing, and—on demand—dispensing, extracting, or otherwise removing liquid. Preferably, the cross-sectional area of the channels 18 is very small so as to allow any one channel 18 to fill readily with liquid independently of the other channels 18. That is, one channel 18 may, for example, be completely filled with a first liquid, while an adjacent channel 18 may contain only air or a second liquid. The channels 18 can be of any cross-sectional profile that provides the desired capillary action (wherein the desired capillary action could include minimal or no capillary action for some applications), and preferably one which is readily replicated.

Figure 3:
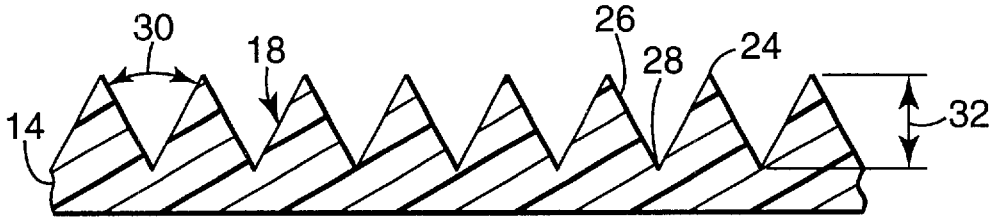
FIG. 3 is a cross-sectional profile of a microstructured layer having V-shaped channels formed between abutted, pointed peaks, which can be incorporated into a liquid dispenser in accordance with the present invention.

As shown in FIGS. 2–3, one channel profile that can be used on a structured surface 16 forms V-shaped channels 18 between a series of abutted, pointed peaks 24, each peak 24 being formed from two planar sidewalls 26. Valleys 28 are formed in between the peaks 24 where two sidewalls 26 intersect. The angular width 30, which (as shown in FIG. 3) is the angle between two planar sidewalls 26 that form a channel 18, can be from about 10° to about 120°, preferably from about 10° to about 90°, and most preferably from about 20° to about 60°. It has been observed that channels 18 with a narrower angular width 30 provide greater capillary action; however, if the angular width 30 is too narrow, the capillary action will become significantly lower. If the angular width 30 is too wide, the channels 18 may fail to provide the desired capillary action. Also, it has been observed that as the angular width 30 gets narrower, the wettability of the structured surface 16 by the liquid need not be as high, to get similar capillary action, as the wettability of the structured surface 16 must be for channels with higher angular widths 30.

Figure 4:
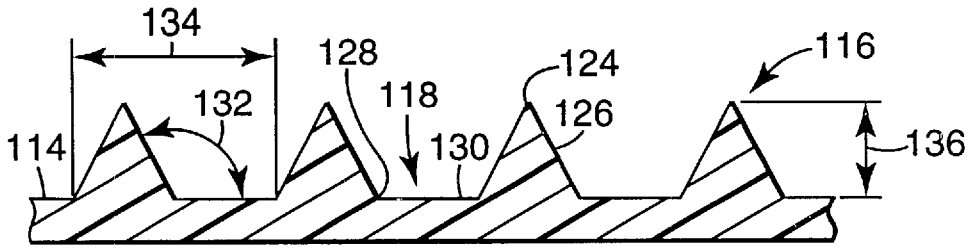
FIG. 4 is a cross-sectional profile of a microstructured layer having channels formed between pointed peaks that are separated by planar floors, which can be incorporated into a liquid dispenser in accordance with the present invention.

Layer 114, another embodiment of a microstructured film that can be used in a liquid dispenser 10 according to the present invention, is shown in FIG. 4. The cross sectional profile of layer 114 includes channels 118 formed on a structured surface 116 of layer 114. The channels 118 have pointed peaks 124 separated by planar floors 130 so that there are two notches 128 in each channel 118 formed at intersections of sidewalls 126 and the planar floors 130. The notches 128 have a notch included angle 132 of from greater than 90° to about 150°, preferably from about 95° to about 120°. The notch included angle 132 is generally the secant angle taken from the notch 128 to a point about 2 microns to about 1000 microns from the notch 128 on the sidewalls 126 and the planar floors 130 forming the notch 128, preferably the notch included angle 132 is the secant angle taken at a point about halfway up the sidewalls 126 and the planar floors 130.

Figure 5:
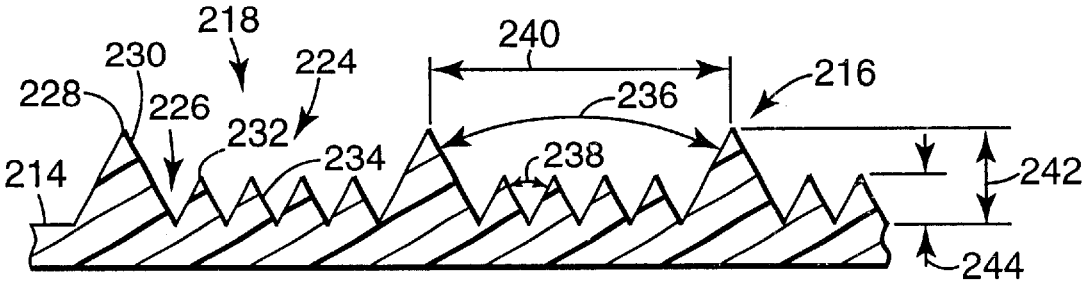
FIG. 5. is a cross-sectional profile of a microstructured layer having channels that include primary and secondary grooves formed between primary and secondary pointed peaks, which can be incorporated into a liquid dispenser in accordance with the present invention.

Layer 214, another embodiment of a microstructured film that can be used in a liquid dispenser 10 according to the present invention, is shown in FIG. 5. The cross sectional profile of layer 214 includes channels 218 formed on a structured surface 216 of layer 214. The channels 218 comprise primary and secondary V-shaped grooves 224 and 226. Primary grooves 224 are located between two pointed primary peaks 228. Each primary peak 228 is formed at the summit of two primary planar sidewalls 230. Secondary grooves 226 are located in between primary peaks 228 and pointed secondary peaks 232 and in between two secondary peaks 232. Each secondary peak 232 is formed at the summit of two secondary planar sidewalls 234. The primary groove angular width 236, which is the angle between two primary planar sidewalls 230 that form a primary groove 224, is less critical but should not be so wide that the primary groove 224 is ineffective in channeling liquid. Generally, the primary channel maximum width 240 is less than about 3000 microns and preferably less than about 1500 microns. The primary angular width 236 of a V-shaped primary groove 224 should generally be from about 10° to about 120°, preferably about 30° to about 90°. If the primary angular width 236 of the primary groove 224 is too narrow, the primary groove 224 may not have sufficient width at its base to accommodate an adequate number of secondary grooves 226. Generally, it is preferred that the primary angular width 236 of the primary groove 224 be greater than the secondary angular width 238, which is the angle between two secondary planar sidewalls 234 that form a secondary groove 226, so as to accommodate the two or more secondary grooves 226 at the base of the primary groove 224. Generally, the secondary grooves 226 have a secondary angular width 238 at least 20 percent smaller than the primary angular width 236 of the primary grooves 224 for V-shaped primary grooves. The depth 242 of the primary grooves and the depth 244 of the secondary grooves 226 are typically substantially uniform.

Figure 6:
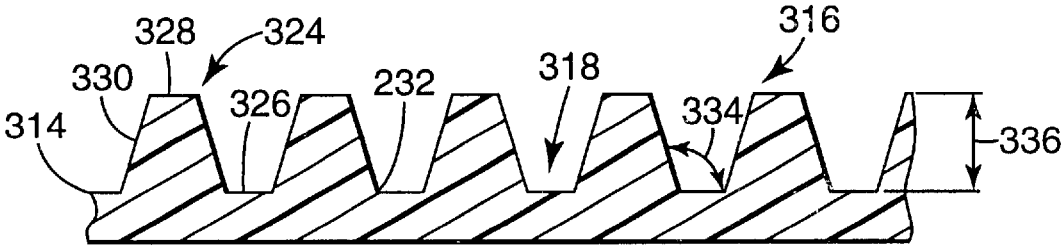
FIG. 6 is a cross-sectional profile of a microstructured layer having channels formed between flat-topped peaks that are separated from one another by planar floors, which can be incorporated into a liquid dispenser in accordance with the present invention.

Layer 314, another embodiment of a microstructured film that can be used in a liquid dispenser 10 according to the present invention, is shown in FIG. 6. The cross sectional profile of layer 314 includes channels 318 formed on a structured surface 316 of layer 314. Channels 318 are formed between flat-topped peaks 324 that are separated by planar floors 326. The peaks 324 have flat tops 328 and two planar sidewalls 330. Notches 332 are formed at the intersections of the planar sidewalls 330 and the planar floors 326. The channels 318 are formed with a notch included angle 334 in the range of from greater than 90° to about 150°, preferably in the range of about 95° to about 120°.

Figure 7:
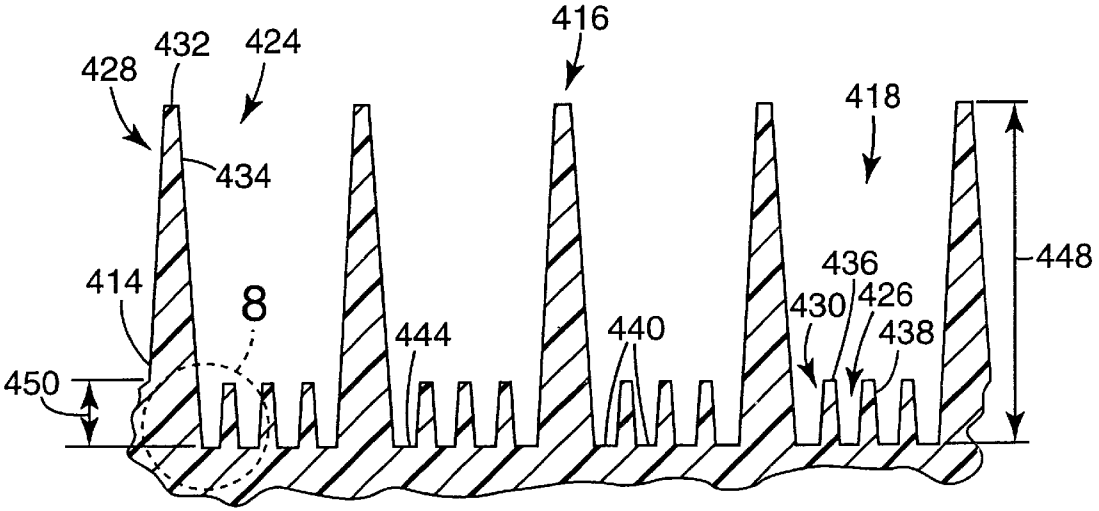
FIG. 7 is a cross-sectional profile of a microstructured layer having primary and secondary grooves formed between primary and secondary flat-topped peaks that are separated from one another by planar floors, which can be incorporated into a liquid dispenser in accordance with the present invention.
Figure 8:
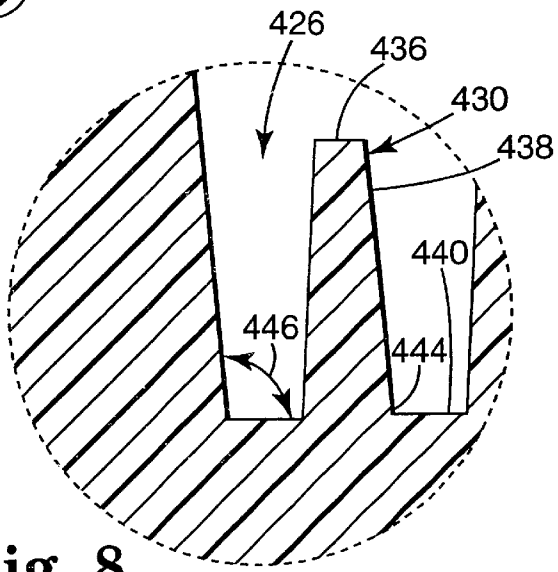
FIG. 8 is a detailed view of a portion of the microstructured layer shown in FIG. 7

Layer 414, yet another embodiment of a microstructured film that can be used in a liquid dispenser 10 according to the present invention, is shown in FIGS. 7–8. The cross sectional profile of layer 414 includes channels 418 formed on a structured surface 416 of layer 414. Channels 418 have primary and secondary grooves 424 and 426, wherein primary grooves 424 are located between two flat-topped primary peaks 428 and secondary grooves 426 are located between primary peaks 428 and flat-topped secondary peaks 430 and between two secondary peaks 430. Each primary peak 428 has a flat primary top 432 and two primary planar sidewalls 434, and each secondary peak 430 has a flat secondary top 436 and two secondary planar sidewalls 438. Planar floors 440 separate the primary and secondary peaks 428 and 430 from each other. Notches 444 are located at the intersections of the planar floors 440 and the primary planar sidewalls 434 and the intersections of the planar floors 440 and the secondary planar sidewalls 438. The channels 418 are formed with a notch included angle 446, shown in FIG. 8, in the range of from greater than 90° to about 150°, preferably in the range of about 95° to about 120°.

Figure 9:
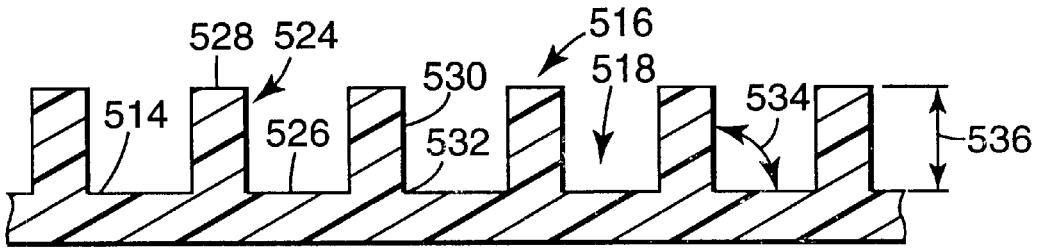
FIG. 9 is a cross-sectional profile of a microstructured layer having rectangular channels formed between rectangular peaks that are separated from one another by planar floors, which can be incorporated into a liquid dispenser in accordance with the present invention.

Layer 514, yet another embodiment of a microstructured film that can be used in a liquid dispenser 10 according to the present invention, is shown in FIG. 9. The cross sectional profile of layer 514 includes channels 518 formed on a structured surface 516 of layer 514. Channels 518 are rectangular and are formed between rectangular peaks 524 that are separated by planar floors 526. The peaks 526 have flat tops 528 and two planar sidewalls 530. Notches 532 are formed at the intersections of the planar sidewalls 530 and the planar floors 526. Preferably, the channels 518 are formed with a notch included angle 534 of about 90°.

The structured surfaces 16, 116, 216, 316, 416, and 516 are microstructured surfaces that define channels 18, 118, 218, 318, 418, or 518, respectively, that have minimum aspect ratios (that is, the ratio of the channel's length to its hydraulic radius) of 10:1, in some embodiments exceeding approximately 100:1, and in other embodiments at least about 1000:1. At the top end, the aspect ratio could be indefinitely high but generally would be less than about 1,000,000:1. The hydraulic radius (that is, the wettable cross-sectional area of a channel divided by its wettable channel circumference) of a channel is no greater than about 300 micrometers. In many embodiments, it can be less than 100 micrometers, and may be less than 10 micrometers. Although smaller is generally better for many applications (and the hydraulic radius could be submicron in size), the hydraulic radius typically would not be less than 1 micrometer for most embodiments.

The structured surface can also be provided with a very low profile. Thus, reservoirs 12 are contemplated where the structured polymeric layer has a thickness of less than 5000 micrometers, and possibly less than 1500 micrometers. To do this, the channels may be defined by peaks that have a height of approximately 5 to 1200 micrometers and that have a peak distance of about 10 to 2000 micrometers.

Microstructured surfaces in accordance with the present invention also provide reservoirs 12 in which the volume of the reservoir 12 is highly distributed (that is, distributed over a large area). Reservoirs 12 having channels defined within these parameters can have volumes of at least about 1.0 microliter, with volumes of at least about 2 milliliters in some applications and volumes of at least about 100 milliliters in other applications. Reservoirs 12 preferably have a microstructure channel density from about 10 per lineal cm (25/in) and up to 1,000 per lineal cm (2500/in) (measured across the channels).

A dispenser 10 having channels 18 defined within these parameters is suitable for acquiring and storing liquid with minimal leakage. Furthermore, the channels 18 can be adapted for the particular liquid being stored and dispensed depending on a number of factors, including the desired effective volume of the reservoir and the viscosity and surface tension of the liquid. For instance, if the liquid is a two-phase liquid having suspended particles (for example, a conventional glitter ink), the width of the channels 18 should be wide enough to allow the particles to pass through the channels 18.

Although FIGS. 1–9 illustrate elongated, linearly-configured channels, the channels may be provided in many other configurations. For example, the channels could have varying cross-sectional widths along the channel length; that is, the channels could diverge and/or converge along the length of the channel. The channel sidewalls could also be contoured rather than being straight in the direction of extension of the channel, or in the channel height. Generally, any channel configuration that can provide the desired capillary action is contemplated.

The making of structured surfaces, and in particular microstructured surfaces, on a polymeric layer such as a polymeric film are disclosed in U.S. Pat. Nos. 5,069,403 and 5,133,516, both to Marentic et al. Structured layers may also be continuously microreplicated using the principles or steps described in U.S. Pat. 5,691,846 to Benson, Jr. et al. Other patents that describe microstructured surfaces include U.S. Pat. 5,514,120 to Johnston et al., U.S Pat. No. 5,158,557 to Noreen et al., U.S. Pat. No. 5,175,030 to Lu et al., and U.S. Pat. No. 4,668,558 to Barber. All of the patents cited in this paragraph are incorporated herein by reference. For example, the layer 14 having a structured surface 16 can be formed by a microreplication process using a tool with a negative impression of the desired pattern and channel profile of the structured surface 16. The tool can be produced by shaping a smooth acrylic surface with a diamond scoring tool to produce the desired microstructure pattern and then electroplating the structure to form a nickel tool suitable for microreplication. The structured surface 16 can then be formed of a thermoplastic material by coating or thermal embossing using the nickel tool.

Structured polymeric layers produced in accordance with such techniques can be microreplicated. The provision of microreplicated structured layers is beneficial because the surfaces can be mass produced without substantial variation from product-to-product and without using relatively complicated processing techniques. "Microreplication" or "microreplicated" means the production of a microstructured surface through a process where the structured surface features retain an individual feature fidelity during manufacture, from product-to-product, that varies no more than about 50 micrometers. The microreplicated surfaces preferably are produced such that the structured surface features retain an individual feature fidelity during manufacture, from product-to-product, which varies no more than 25 micrometers.

In accordance with the present invention, a microstructured surface comprises a surface with a topography (the surface features of an object, place or region thereof) that has individual feature fidelity that is maintained with a resolution of between about 50 micrometers and 0.05 micrometers, more preferably between 25 micrometers and 1 micrometer.

Layers for any of the embodiments in accordance with the present invention can be formed from a variety of polymers or copolymers including thermoplastic, thermoset, and curable polymers. As used here, thermoplastic, as differentiated from thermoset, refers to a polymer which softens and melts when exposed to heat and re-solidifies when cooled and can be melted and solidified through many cycles. A thermoset polymer, on the other hand, irreversibly solidifies when heated and cooled. A cured polymer system, in which polymer chains are interconnected or crosslinked, can be formed at room temperature through use of chemical agents or ionizing irradiation.

Polymers useful in forming a layer having a structured surface according to the present invention include but are not limited to polyolefins such as polyethylene and polyethylene copolymers, polyvinylidene diflouride (PVDF), and polytetrafluoroethylene (PTFE). Other polymeric materials include acetates, cellulose ethers, polyvinyl alcohols, polysaccharides, polyolefins, polyesters, polyamids, poly (vinyl chloride), polyurethanes, polyureas, polycarbonates, and polystyrene. Structured layers can be cast from curable resin materials such as acrylates or epoxies and cured through free radical pathways promoted chemically, by exposure to heat, UV, or electron beam radiation.

As described in more detail below, there are applications where flexible layers 14 are desired. Flexibility may be imparted to a structured polymeric layer using polymers described in U.S. Pat. No. 5,450,235 to Smith et al. and U.S. Pat. No. 5,691,846 to Benson, Jr. et al, both of which are incorporated herein by reference. The whole polymeric layer need not be made from a flexible polymeric material. A main portion of the polymeric layer, for example, could comprise a flexible polymer, whereas the structured portion or portion thereof could comprise a more rigid polymer. The patents cited in this paragraph describe use of polymers in this fashion to produce flexible products that have microstructured surfaces.

Polymeric materials including polymer blends can be modified through melt blending of plasticizing active agents such as surfactants or antimicrobial agents. Surface modification of the structured surfaces can be accomplished through vapor deposition or covalent grafting of functional moieties using ionizing radiation. Methods and techniques for graft-polymerization of monomers onto polypropylene, for example, by ionizing radiation are disclosed in US Pat. Nos. 4,950,549 and U.S. Pat. Nos. 5,078,925, both of which are incorporated herein by reference. The polymers may also contain additives that impart various properties into the polymeric structured layer. For example, plasticizers can be added to decrease elastic modulus to improve flexibility.

Preferred embodiments of the invention may use thin flexible polymer films that have parallel linear topographies as the microstructure-bearing element. For purposes of this invention, a "film" is considered to be a thin (less than 5 mm thick) generally flexible sheet of polymeric material. The economic value in using inexpensive films with highly defined microstructure-bearing film surfaces is great. Flexible films can be used in combination with a wide range of capping materials.

Because the devices of the invention include microstructured channels, the devices commonly employ a multitude of channels per device. As shown in some of the embodiments illustrated below, inventive devices can easily possess more than 10 or 100 channels per device. In some applications, the device may have more than 1,000 or 10,000 channels per device.

In the embodiment shown in FIG. 1, reservoir 12 of dispenser 10 is formed by stacking layers 14, one on- top of another. In this manner, any number of layers 14 can be stacked together to form a reservoir 12 having a desired liquid capacity (defined by the effective volume within the channels 18) for a particular application. One advantage of direct stacking of layers 14 on each other is that the second major surface of each layer 14 provides a cap on the channels 18 of the lower adjacent layer 14. Therefore, each channel 18 can become a discrete capillary that can acquire, store, and dispense liquid in a manner independent of the other channels 18 in the reservoir 12. Indeed, it is possible to store more than one type of liquid in such a reservoir 12 by filling different zones of channels 18 with different liquids.

Also, a layer 14 can be bonded to the peaks 24 of some or all of the structured surface 16 of an adjacent layer 14 to enhance the creation of discrete channels 18. This can be done using conventional adhesives that are compatible with the materials of the layers 14, or this can be done using heat bonding, ultrasonic bonding, mechanical devices, or the like.

Bonds may be provided entirely along the peaks 24 to the adjacent surface 16, or may be spot bonds provided in accordance with an ordered pattern, or randomly. Alternatively, the layers 14 may simply be stacked upon one another whereby the compressive force of the stack (due to, for example, gravity acting upon the layers 14 or a housing surrounding the stack) adequately enhances the creation of discrete flow channels 18. However, in some applications, layers 14 may not need to be sealed to one another in order to create the desired capillary action in the channels 18.

To close off some, preferably all, of the channels 18 of the uppermost layer 14, a cap layer 38 can also be provided, as shown in FIG. 1. This cap layer 38 can be bonded or unbonded in the same or a different manner as the inter-layer bonding described above. The material for cap layer 38 can be the same or different from the material of the layers 14 and can be substantially impermeable or permeable to the liquid stored in the reservoir. Alternatively, the cap layer 38 can be formed integrally with a housing (not shown in FIG. 1) that surrounds the reservoir 12 or liquid dispenser 10. The cap layer 38 typically has a thickness of about 0.01 millimeters to about 1 millimeter, more typically 0.02 millimeters to 0.5 millimeters.

The layers 14 of the reservoir 12, as shown in FIG. 2, can be stacked, capped, and/or otherwise layered so that the channels 18 are aligned in a precise array with the channels 18 of each layer 14 lined up with the channels 18 of the other layers 14, thereby presenting a regular, aligned capillary pattern with the dispensing edges 22 of the layers 14 flush so as to form a dispensing surface 40 containing a plurality of outlets 20. Alternatively, these channels 18 can be offset in a regular, repeating manner, or they can be offset in a controlled manner. In addition, other channel and layer configurations are contemplated. Moreover, the layers 14 can be stacked so that at least some of the layers 14 have channels 18 that are not parallel to the channels 18 in some of the other layers 14 (for example, aligning the channels 18 of a first group of layers 14 perpendicular to the channels 18 of a second group of layers 14) so as to define at least two dispensing surfaces 40 that are a not parallel to one another.

In the embodiment shown in FIG. 1, at least one transfer element 42 is in fluid communication with at least one dispensing surface 40 of the reservoir 12 and the dispensing edges 22 contained thereon. Transfer element 42 provides a location from which liquid stored in the reservoir 12 can be controllably dispensed by applying or developing a potential sufficient to overcome the attractive forces between the walls of the channels 18 and the liquid stored within the channels 18 in order to draw the liquid out of the channels 18 through the transfer element 42. Transfer element 42 can comprise any structure capable of applying or developing such a potential. For example, the transfer element 42 can comprise a second capillary structure. A capillary structure that promotes isotropic spreading (that is, the spreading of liquids in all directions at the same rate) of a liquid through the structure, such as open cell foams, fibrous masses, and sintered materials, can be used as a transfer element 42. Such an isotropic transfer element 42 can serve as a type of manifold to collect and combine liquid from the several channels 18 for dispensing. Also, two or more separate transfer elements 42 can be used on a single dispensing surfaces 40 where, for example, different liquids are stored in different zones of channels 18 within the reservoir 12. In such an example, there could be a separate transfer element 42 in fluid communication with the channels 18 of each of the channel zones, wherein the transfer elements 42 are separated from (that is, substantially not in fluid communication with) each other.

A suitable liquid can be stored in the reservoir 12 by inserting at least a portion of the dispensing surface 40 of the reservoir 12 into (or by otherwise bringing the dispensing surface 40 into fluid communication with) the liquid. A suitable liquid can be a liquid that can substantially wet the interior surface of the channels 18 so that a portion of the liquid will move into the channels 18 due to capillary action, and attractive forces will be created between the liquid in the channels 18 and the walls of the channels 18. When the dispensing surface 40 is removed from the liquid (or fluid communication between the dispensing surface 40 and the liquid is otherwise prevented), the attractive forces between the liquid and the channels 18 will be sufficient to retain the liquid within the channels 18. Alternatively, liquid (for example, liquid that cannot substantially wet the structured surface 16) can be forced into the channels 18 of reservoir 12 under pressure or other force and then the layers 14 can be sealed so as to prevent leakage, or the reservoir 12 can be formed with liquid already in channels 18, for example, by stacking layers 14 having channels 18 that are wetted with liquid.

The liquid in the channels 18 can be controllably dispensed from the reservoir 12 by developing a potential that can overcome the attractive forces and draw the liquid out of the channels 18. Transfer element 42, brought into fluid communication with the dispensing surface 40 of the reservoir 12, can be used to provide a location where the potential can be applied or developed so as to controllably dispense liquid from the reservoir 12. For example, the potential to draw the liquid from the channels 18 can be developed by bringing an aspirator into fluid communication with the transfer element 42 so as to develop a vacuum within the transfer element 42 that will suck the liquid from the channels 18. Alternatively, the potential can be developed by deforming the transfer element 42 (for example, by pressing the transfer element 42 against an external surface) or altering a characteristic of the transfer element 42 (for example, increasing the wettability of the transfer element 42 by saturating it with a surfactant) so as to increase the capillary force created by the transfer element 42 relative to the capillary force created by the channels 18 in order to draw liquid from the channels 18. Also, the potential can be developed by forcing a fluid (for example, a pressurized gas) into one end of the channels 18 so that the liquid is blown out through the other end. In addition, liquid can be dispensed, extracted, or otherwise removed from the reservoir 12 in other ways—with or without developing a potential and with or without using a transfer element 42—for example, by inserting the needle of a syringe directly into the reservoir 12 and transferring liquid from the reservoir 12 into the syringe.

Figure 10:
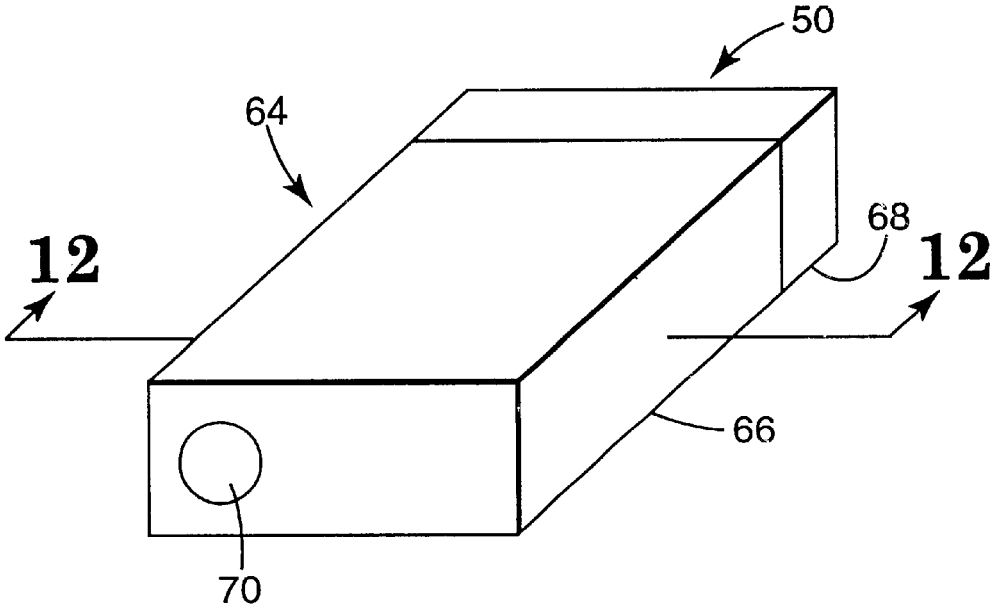
FIG. 10 is an isometric view of a liquid dispenser according to the present invention in the form of an ink jet cartridge.
Figure 11:
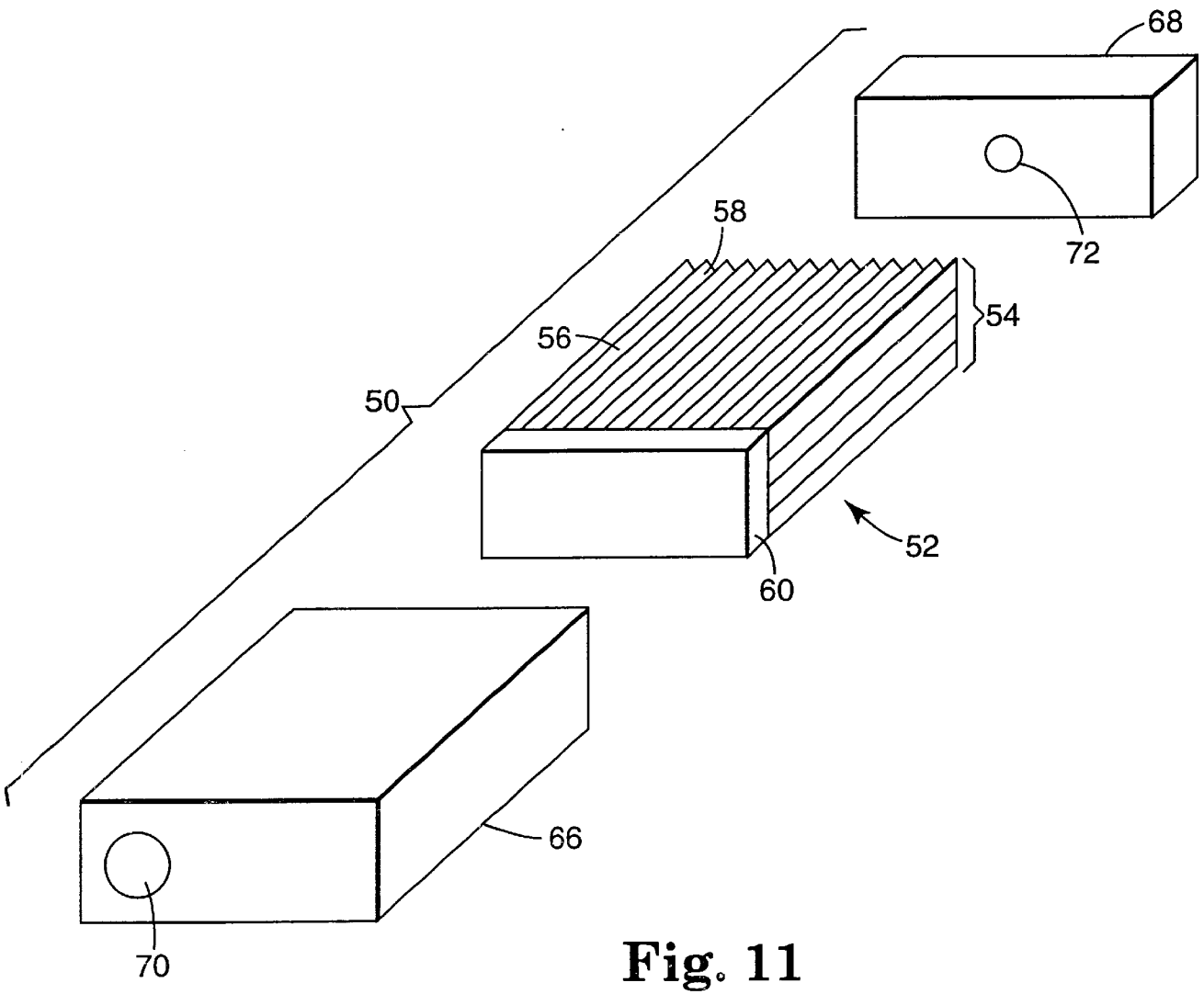
FIG. 11 is an exploded, isometric view of the ink jet cartridge shown in FIG. 10.
Figure 12:
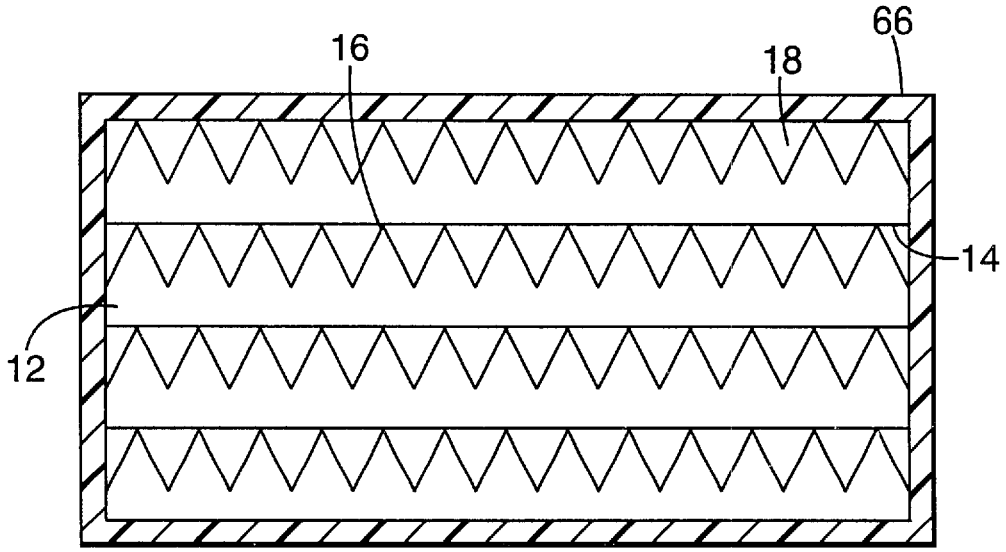
FIG. 12 is a detailed, cross-sectional view of the ink jet cartridge shown in FIG. 10 taken along the plane 12—12.

Reservoirs 12 and liquid dispensers 10 of the present invention can be used in variety of applications. For instance, a liquid dispenser according to the present invention can be made in the form of an ink jet cartridge 50 that can be used to dispense ink to a conventional ink jet-type printer. As shown in FIGS. 10–12, ink jet cartridge 50 comprises a reservoir 52 formed from overlaying layers 54 of material having at least one structured surface 56 on which a plurality of channels 58 is formed. A transfer element 60 is in fluid communication with a dispensing surface (not shown in FIGS. 10–12) formed on a surface of the reservoir 52. Reservoir 52, layers 54, structured surfaces 56, channels 58, transfer element 60, and the dispensing surface of reservoir 52 correspond to reservoir 12, layers 14, structured surfaces 16, channels 18, transfer element 42, and dispensing surface 40, respectively, described above in connection with the generalized liquid dispenser 10 shown in FIGS. 1–9. A housing 64 comprising, for example, first and second housing pieces 66 and 68, surrounds the reservoir 52 and the transfer element 60 and is shaped to be inserted into a conventional printhead (not shown) of an ink jet-type printer. A first opening 70 is formed in the housing 64 so that fluid communication between the transfer element 60 and the printhead can be established to apply or develop a potential sufficient to draw ink from the ink jet cartridge 50. Typically, a second opening 72 is formed in the housing 64 to promote the flow of air into the ink jet cartridge 50, which facilitates the removal of ink.

Ink is stored in the reservoir 52 of the cartridge 50 by, for example, inserting the dispensing surface into the ink so that capillary action causes ink to move into the channels 58. Alternatively, ink can be forced into the channels 58 by pressure or other force. The transfer element is then affixed to the dispensing surface and the reservoir 52 is inserted into and surrounded by the housing 64. Ink is controllably dispensed from the cartridge 50 in a conventional manner by inserting the cartridge 50 into a convention ink-jet printhead, which develops a potential sufficient to draw the ink from the channels 58 through the first opening 70 in the printing process. Reservoir 52 of cartridge 50 preferably has a liquid capacity in the range of about 7 milliliters to about 10 milliliters, although cartridges 50 having reservoirs 52 with liquid capacities outside of this range are also contemplated.

Figure 13:
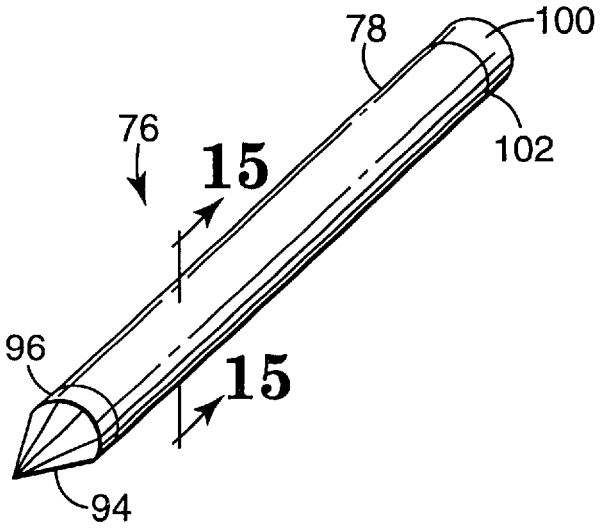
FIG. 13 is an isometric view of a liquid dispenser according to the present invention in the form of a writing instrument.
Figure 14:
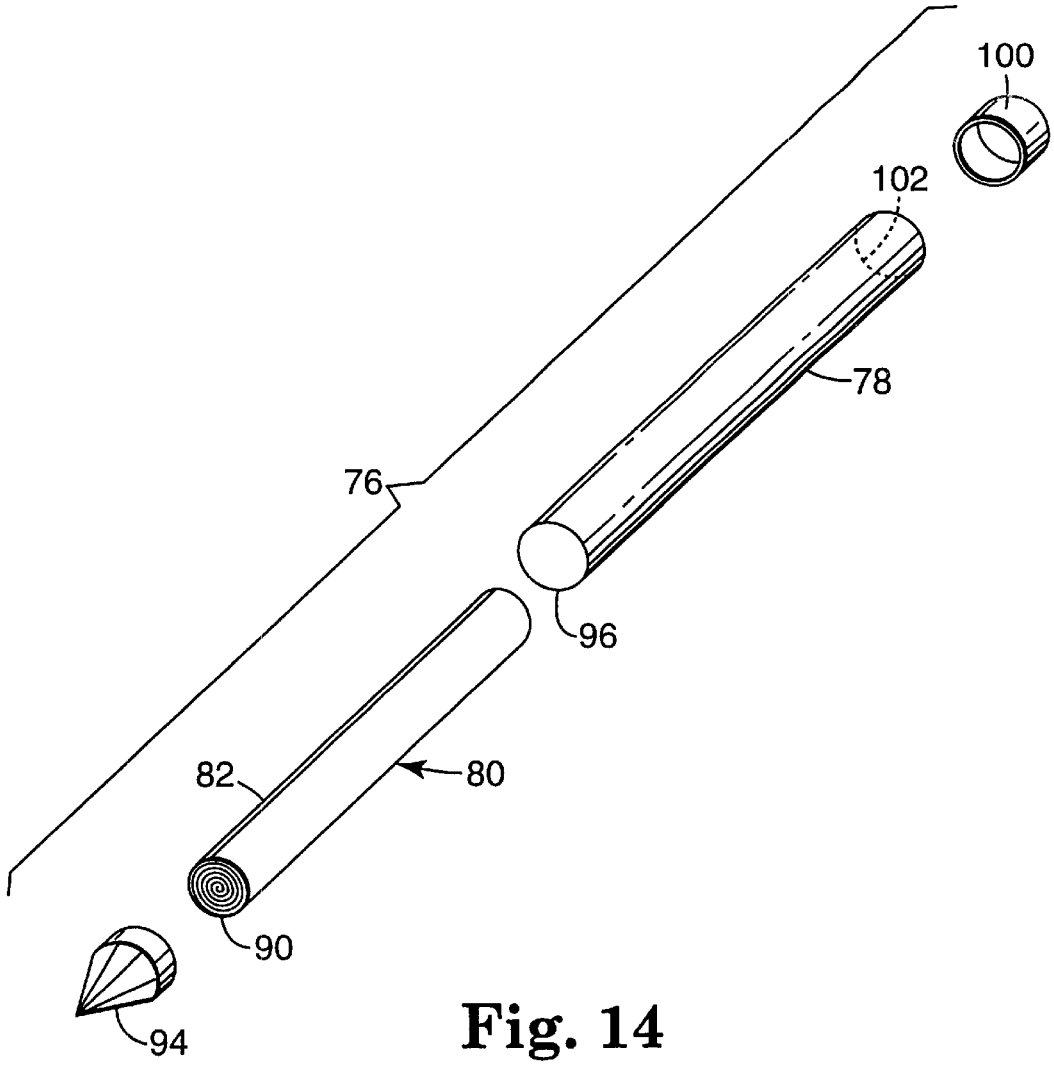
FIG. 14 is an exploded, isometric view of the writing instrument shown in FIG. 13.
Figure 15:
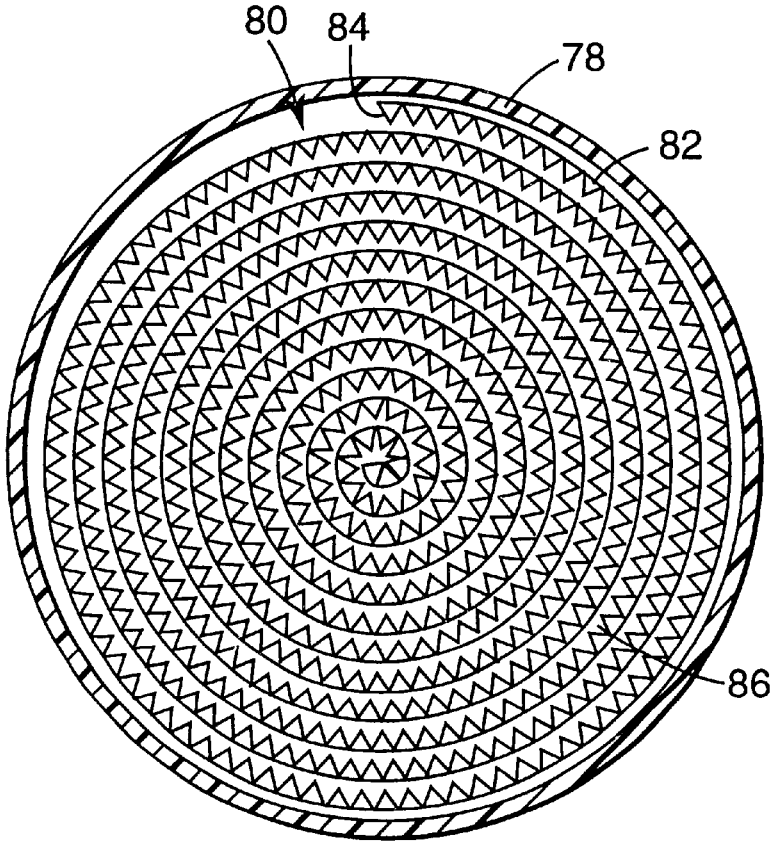
FIG. 15 is a detailed, cross-sectional view of the writing instrument shown in FIG. 13 taken along the plane 15—15.

A liquid dispenser according to the present invention can also be made in the form of a writing instrument 76 that stores and dispenses ink. As shown in FIGS. 13–15, writing instrument 76 comprises a housing 78 surrounding a reservoir 80 according to the present invention. The housing 78 typically has an elongated, cylindrical, hollow shape. In the embodiment shown in FIGS. 13–15, the reservoir 80 is formed from a single, spirally wound layer 82 of material having at least one structured surface 84 (shown in FIG. 15). The structured surface 84 has a plurality of channels 86 (shown in FIG. 15) that are aligned with the axis around which layer 82 is spirally wound. Each channel 86 has at least one outlet (not shown in FIGS. 13–15) located at an edge of layer 82. A dispensing surface 90 (shown in FIG. 14) having a plurality of outlets located thereon is formed by spirally winding the layer 82. Writing instrument 76 has a transfer element in the form of a nib 94 that is inserted into a first opening 96 of the housing 78 so that a portion of the nib 94 is in fluid communication with the dispensing surface 90 of the reservoir 80. An end cap 100 is inserted into a second opening 102 of the housing 78 to secure the reservoir 80 within the housing 78. Reservoir 80, layer 82, structured surfaces 84, channels 86, nib 94, and the dispensing surface 90 correspond to reservoir 12, layers 14, structured surface 16, channels 18, transfer element 42, and dispensing surface 40, respectively, described above in connection with the generalized liquid dispenser 10 shown in FIGS. 1–9.

Ink is stored in the writing instrument 76, for example by inserting the dispensing surface 90 into ink so that ink is drawn into the channels 86 by capillary action. The dispensing surface 90 is then removed from the ink. Alternatively, ink can be forced into the channels 86 by pressure or other force. The nib 94 is inserted into the first opening 96 so that the nib 94 is in fluid communication with the dispensing surface 90. A potential sufficient to draw ink from the reservoir 80 can be developed, for example, by pressing the nib 94 on a surface in order to mark the surface with ink. Reservoir 80 of writing instrument 76 preferably has a liquid capacity of about 2 milliliters, although writing instruments 76 having reservoirs 80 with other liquid capacities are also contemplated.

Figure 16:
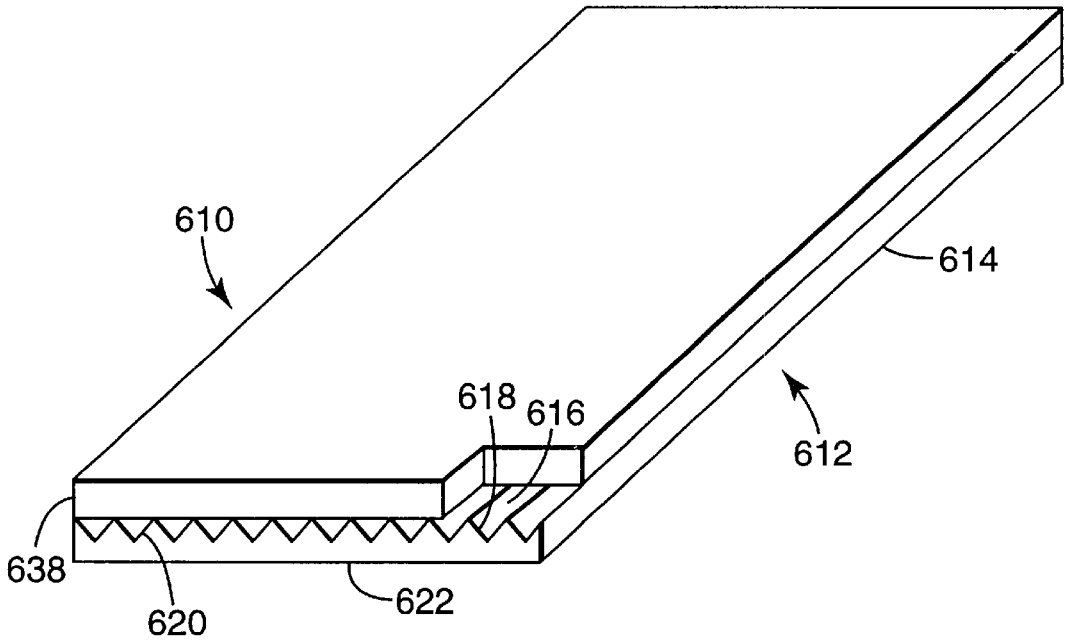
FIG. 16 is an isometric view of a reservoir according to the present invention having a single microstructured layer wherein a portion of a cap layer is removed to show a portion of the structured surface.

Another embodiment of the present invention is a single layer liquid dispenser 610 shown in FIG. 16. Liquid dispenser 610 has a reservoir 612 formed from a single layer 614 having a structured surface 616 of elongated channels 618 that are capped with a cap layer 638 to form capillaries for storing liquid. Each channel 618 has at least one outlet 620 formed along a dispensing edge 622 of the layer 614. Cap layer 638 can comprise any type of layer including another layer 614 or a portion of a housing (not shown) that can surround the reservoir 612. Also, the liquid dispenser 610 can be formed without a transfer element (as shown in FIG. 16) or with a transfer element (not shown). Reservoir 612, layer 614, structured surfaces 616, channels 618, outlets 620, the dispensing edge 622, and the cap layer 638 correspond to reservoir 12, layers 14, structured surface 16, channels 18, outlets 20, dispensing edge 22, and the cap layer 38, respectively, described above in connection with the generalized liquid dispenser 10 shown in FIGS. 1–9.

Liquid can be stored in and dispensed, extracted, or otherwise removed from the single layer dispenser 610 as described above in connection with the generalized liquid dispenser 10. Dispenser 610 can be used as a micro-liquid containment device useful in applications where a small volume of liquid is involved such as combinatorial chemistry, archival micro-liquid storage, or portable micro-liquid delivery. For example, a dispenser 610 can be formed having a reservoir 612 with a layer 614 that is 1 cm wide, 3 cm long, and has channel sizes in the range from about 5 micrometers to about 1200 micrometers in order to store a volume of liquid of at least about 1.0 microliter, preferably at least about 25 microliters.

EXAMPLE 1

An ink jet cartridge 50 of the type shown in FIGS. 10–12 was assembled from 14 layers of 40 mm ×30 mm microreplicated film having linear channels 58 formed thereon. A thin layer of blown microfiber was used as an isotropic transfer element 60. This assembly was then housed in a conventional ink jet cartridge housing 64. The prototype cartridge was composed of 100% polyolefin materials. The microstructure-bearing film layer used in the cartridge 50 was formed generally according to the process disclosed in U.S. Pat. Nos. 5,514,120 and 5,728,446 by casting a molten polymer onto a microstructured nickel tool to form a continuous film with channels 58 on one structured surface 56. The channels 58 were formed in the continuous length of the cast film. The nickel casting tool was produced by shaping a smooth acrylic surface with diamond scoring tools to produce the desired structure followed by an electroplating step to form a nickel tool. The tool used to form the film produced a microstructured surface 56 on the film layer 54 with a channel profile of the type shown in FIG. 7 having primary grooves with a primary groove angular width of 10°, a primary groove spacing of 229 micrometers, a primary groove depth of 203 micrometers, and a notch included angle of 95°, and secondary grooves with a secondary groove angular width of 95°, a secondary groove spacing of 50 micrometers, and a secondary groove depth of 41 micrometers. The channels 58 had a primary peak top width of 29 micrometers and a secondary peak top width of 163 micrometers as well as a primary groove base width of 163 micrometers and a secondary groove base width of 13 micrometers. Also, the channels 58 had a primary groove wall angular width of 10°. The polymer used to form the film was low density polyethylene, Tenite™ 155OP from Eastman Chemical Company. A nonionic surfactant, Triton X-102 from Union Carbide Corporation, was melt blended into the base polymer to increase the surface energy and wettability of the film. The blown microfiber transfer element 60 was a 2 mm layer of 3M Chemical Sorbent. The housing 64 used was from a Canon Ink Cartridge, type BJI-201Y, which had all internal elements (including foam and partitions) removed.

The ability of the ink jet cartridge 50 to retain and effectively dispense ink was evaluated by filling the unit with 7 grams of conventional printer ink. When filled, the inkjet cartridge 50 was held in varying orientations in an effort to cause leakage. Regardless of orientation, the ink jet cartridge 50 did not spontaneously dispense ink through the opening 70 of the cartridge housing 64. Controlled liquid dispensing efficiency was evaluated using a small aspirator to extract ink from the ink jet cartridge 50. The aspirator, with a 2 mm tip opening, was placed in close proximity to the transfer element 60 and protruded into the ink jet cartridge opening 70. A vacuum was then applied to the aspirator and the ink withdrawn from the channels 58 of the inkjet cartridge 50. Using this method 6.4 grams of ink was withdrawn from the ink jet cartridge 50.

The prototype cartridge 50, described as Example 1, demonstrated that multiple layers 54 of microreplicated film can be efficiently employed as both containment and dispensing means for fluids, with special application to the needs of ink jet type printers.

EXAMPLE 2

A marker 76, which is a type of writing instrument shown in FIGS. 13–15, was produced by forming a spirally wound reservoir 80 from a microstructured film layer 82 fabricated as in Example 1 having a structured surface 84 with a channel profile of the type shown in FIG. 3 containing V-shaped channels 86 having a groove angular width of 90°, a groove spacing of 16 micrometers, and a groove depth of 8 micrometers. The layer 82 was wound into a tight 1 cm diameter spiral, and then inserted into a housing 78 that was obtained by removing the internal parts of a conventional marking pen. A conventional fibrous marker nib 94 was used as the transfer element. The marker 70 was charged by placing the end of the marker 70 into a container of ink. When the ink made contact with the reservoir 80, it was drawn up into the channels 86 until the channels 86 were filled. The nib 94 was then inserted into the housing opening 96, and a conventional pen cap was used to cover the nib 94 when not in use.

Ink was dispensed from the marker 70 by removing the cap and pressing the nib 94 onto a surface (paper). The marker 70 functioned well, producing skip-free, continues lines. The marker 70 also passed drop tests to determine if ink would spray out of the marker 70 when impacted. The drop test included dropping the marker 70 (with the cap over the nib 94) from about 3 feet onto a hard surface, cap side down. This test was repeated 5 times, and then the cap was inspected for any ink that may have been released. No ink was observed in the cap.

Although the present invention has been described with reference to preferred embodiments, workers skilled in the art will recognize that changes may be made in form and detail without departing from the spirit and scope of the invention.

What claimed is:

1. A reservoir for storing and controllably dispensing liquid, comprising:

at least one layer of microstructured film including:

a plurality of elongated channels formed in a structured surface of the film; and a dispensing edge; and a cap layer adjacent to the structured surface and covering the elongated channels, wherein the cap layer is formed from material which is substantially impermeable to the liquid stored in the reservoir, and wherein the liquid can be retained within the channels by the cap layer and controllably dispensed from the channels at the dispensing edge.

2. The reservoir of claim 1, wherein the at least one layer of film is substantially impermeable to ink.

3. The reservoir of claim 1, wherein the at least one layer of film has a thickness less than 5,000 micrometers.

4. The reservoir of claim 1, wherein the reservoir has a capacity to hold a total volume of liquid of at least about 1 microliter.

5. The reservoir of claim 1, wherein the at least one layer has at least about 100 channels.

6. The reservoir of claim 1, wherein the elongated channels have an aspect ratio of at least about 10:1.

7. The reservoir of claim 1, wherein the elongated channels are V-shaped.

8. The reservoir of claim 1, wherein the elongated channels have a rectangular shape.

9. The reservoir of claim 1, wherein elongated channels have a hydraulic radius no greater than about 300 micrometers.

10. The reservoir of claim 1, wherein the elongated channels are defined by peaks that have a height of approximately 5 to 1,200 micrometers and that have a peak distance of about 10 to 2,000 micrometers.

11. The reservoir of claim 1, wherein a density of the channels in the film is from about 10 per lineal centimeter up to 1,000 per lineal centimeter.

12. The reservoir of claim 1, wherein the at least one layer of film is polymeric.

13. The reservoir of claim 1, wherein the at least one layer of film is substantially impermeable to aqueous liquids.

14. An ink jet cartridge, comprising:

a housing having an opening;

a reservoir located within the housing including a plurality of covered elongated channels formed from overlying layers of microstructured film each having a plurality of elongated channels formed in a structured surface of the film layer and each having a dispensing edge, with each elongated channel having an outlet at the dispensing edge, wherein the microstructured film is formed from material which is substantially impermeable so liquid can be stored in the channels of the microstructured film layers; and a transfer element in fluid communication with the dispensing edge of the reservoir and located within the housing so that the transfer element is accessible through the opening so as to provide a location from which liquid stored in the channels of the reservoir can be controllably dispensed.

15. The ink jet cartridge of claim 14, wherein the elongated channels have a hydraulic radius no greater than about 300 micrometers and an aspect ratio of at least about 10:1.

16. A liquid dispenser for storing and dispensing liquid, comprising:

a reservoir including a plurality of covered elongated channels formed from overlying layers of rnicrostructured film formed from material which is substantially impermeable to the liquid being stored, each microstructured film layer having a plurality of elongated channels formed in a structured surface of the film layer and a dispensing edge, with each elongated channel having an outlet at the dispensing edge, wherein liquid can be stored in the channels of the microstructured film layers; and a transfer element in fluid communication with the dispensing edge of the reservoir providing a location from which liquid stored in the channels of the reservoir can be controllably dispensed.

17. The liquid dispenser of claim 16, wherein the reservoir has a capacity to hold a total volume of liquid of at least about 1 microliter.

18. The liquid dispenser of claim 16, wherein each layer has at least about 100 channels.

19. The liquid dispenser of claim 16, wherein each elongated channel has an aspect ratio of at least about 10:1.

20. The liquid dispenser of claim 16, wherein the elongated channels are V-shaped.

21. The liquid dispenser of claim 16, wherein the elongated channels have a rectangular shape.

22. The liquid dispenser of claim 16, wherein each elongated channel has a hydraulic radius no greater than about 300 micrometers.

23. The liquid dispenser of claim 16, wherein the elongated channels are defined by peaks that have a height of approximately 5 to 1,200 micrometers and that have a peak distance of about 10 to 2,000 micrometers.

24. The liquid dispenser of claim 16, wherein a density of the channels in the film is from about 10 per lineal centimeter up to 1,000 per lineal centimeter.

25. The liquid dispenser of claim 16, wherein the overlying layers are polymeric.

26. The liquid dispenser of claim 16, wherein the transfer element comprises two or more transfer elements in fluid communication with the dispensing edge of the reservoir.

27. The liquid dispenser of claim 16, wherein the overlying layers are substantially impermeable to ink.

28. The liquid dispenser of claim 16, wherein each of the overlying layers has a thickness less than 5,000 micrometers.

29. The liquid dispenser of claim 16, wherein the elongated channels are U-shaped.

30. The liquid dispenser of claim 26 wherein:

the plurality of elongated channels comprises first and second elongated channels; and the transfer elements include first and second transfer elements, and wherein the first transfer element is in fluid communication with the first channel and the second transfer element is in fluid communication with the second channel.

31. The ink jet cartridge of claim 14, wherein the transfer element includes a fibrous layer.

* * * * *

UNITED STATES PATENT AND TRADEMARK OFFICE

CERTIFICATE OF CORRECTION

PATENT NO. : 6,431,695 B1
DATED : August 13, 2002
INVENTOR(S) : Johnston, Raymond P.

It is certified that error appears in the above-identified patent and that said Letters Patent is hereby corrected as shown below:

Column 15,
Line 21, delete “rnicrostruc” and insert in place thereof -- microstruc --.

Signed and Sealed this

First Day of July, 2003

JAMES E. ROGAN
*Director of the United States Patent and Trademark Office*